US006835017B2

(12) United States Patent
Eddington

(10) Patent No.: US 6,835,017 B2
(45) Date of Patent: Dec. 28, 2004

(54) CLIP RETENTION PLUG

(75) Inventor: Ryan S. Eddington, Dallas City, IL (US)

(73) Assignee: BIC Corporation, Milford, CT (US)

( * ) Notice: Subject to any disclaimer, the term of this patent is extended or adjusted under 35 U.S.C. 154(b) by 8 days.

(21) Appl. No.: 10/196,219

(22) Filed: Jul. 17, 2002

(65) Prior Publication Data

US 2004/0013460 A1 Jan. 22, 2004

(51) Int. Cl.[7] ..... B43K 23/02
(52) U.S. Cl. ..... 401/131; 24/11 R
(58) Field of Search ..... 401/131, 195, 401/52; 24/10 R, 11 R, 457, 458, 11 F, 11 P, 11 HC

(56) References Cited

U.S. PATENT DOCUMENTS

| | | | | |
|---|---|---|---|---|
| 532,245 A | | 1/1895 | Petterson et al. | |
| 919,244 A | | 4/1909 | Rider | |
| 1,111,469 A | * | 9/1914 | Kraker | 24/11 F |
| 1,197,224 A | | 9/1916 | Moore | |
| 1,271,430 A | * | 7/1918 | Bush | 222/555 |
| 1,353,215 A | | 9/1920 | Campbell | |
| 1,360,230 A | | 11/1920 | Kristofek | |
| 1,506,207 A | | 8/1924 | Wahl | |
| 1,548,548 A | * | 8/1925 | Patten | 24/11 F |
| 2,368,425 A | | 1/1945 | Reynolds | |
| 2,690,736 A | | 10/1954 | Musser | |
| 2,804,049 A | | 8/1957 | Sams | |
| 3,041,693 A | * | 7/1962 | Simon, Jr. et al. | 24/11 F |
| 3,608,154 A | | 9/1971 | Ira | |
| 3,638,280 A | | 2/1972 | Di Spirito | |
| 3,683,484 A | | 8/1972 | Kolster et al. | |
| 4,588,317 A | | 5/1986 | Taylor | |
| 4,706,341 A | * | 11/1987 | Celaries | 24/11 R |
| 5,259,095 A | | 11/1993 | Tam | |
| 5,570,965 A | | 11/1996 | Coolen | |
| 5,906,342 A | | 5/1999 | Kraus | |
| 6,045,281 A | | 4/2000 | Bunn et al. | |
| 6,167,596 B1 | | 1/2001 | Berman | |
| 6,519,813 B1 | * | 2/2003 | Lin et al. | 24/11 F |

FOREIGN PATENT DOCUMENTS

| | | |
|---|---|---|
| DE | 32 29 200 A1 | 2/1984 |
| JP | 411034574 A | 2/1999 |
| WO | WO 94/05513 | 3/1994 |

* cited by examiner

*Primary Examiner*—David J. Walczak
(74) *Attorney, Agent, or Firm*—Jones Day

(57) ABSTRACT

An improved clip retention apparatus and to a method for attaching a clip to a writing instrument. The clip retention apparatus may comprise a clip, first and second plug bodies, and a retainer element. A portion of the clip may be disposed between the plug bodies, and the plug bodies may be coupled to the retainer element. The retainer element may be coupled with a writing instrument or formed as part of a writing instrument. The clip, plug bodies, and retainer element may be configured and arranged so that movement of the clip between the plug bodies is at least inhibited.

40 Claims, 6 Drawing Sheets

CLIP RETENTION PLUG

FIELD OF THE INVENTION

The present invention relates to an apparatus for securing a clip to a writing instrument.

BACKGROUND OF THE INVENTION

Various clip retention mechanisms have been used in the past to secure a clip to a writing instrument. For example, in one prior art mechanism, a metallic clip is formed with sharp attachment prongs extending from one end of the clip. The sharp prongs are pressed into a slotted cap or barrel of a writing instrument and folded over to secure the clip tightly against the writing instrument. Such a clip retention mechanism is generally inexpensive to manufacture. However, the mechanism may loosen over time as the prongs work themselves free from the writing instrument. In addition, if the outer surface of the metallic clip is plated, for example with a nickel plating, the plating may flake or crack when the attachment prongs are folded over, making the clip more susceptible to corrosion. Further, insertion of the metallic attachment prongs into a cap or barrel may deform the cap or barrel around the insertion point.

Alternative prior art clip retention mechanisms may overcome some of the disadvantages described above. However, such mechanisms may require secondary attachment materials such as glue, which is generally messy, requires time to dry, and which may also loosen over time. Other clip retention mechanisms avoid the use of glue but may be more expensive or complex to manufacture. For example, clips have been welded to writing instruments in the past. However, imperfect welding techniques can burn the clip or the writing instrument, marring their finish.

SUMMARY OF THE INVENTION

The present invention relates generally to an improved clip retention apparatus for securing a clip to a writing instrument. The present invention is relatively gentle to both the clip and the writing instrument and preferably permits application of a clip to any type of writing instrument.

According to one aspect of the present invention, at least a portion of a clip may be disposed between a first plug body and a second plug body. A retainer element may be configured and arranged to engage the plug bodies so that the plug bodies engage the portion of the clip, thereby inhibiting movement of the portion of the clip with respect to the plug bodies. The retainer element may be shaped for coupling with a writing instrument, or the retainer element may be formed as part of the writing instrument.

In one embodiment of the present invention, the portion of the clip maintained between the plug bodies defines a first mating surface, and at least one of the plug bodies defines a second mating surface. In such an embodiment, the first mating surface may engage the second mating surface to at least inhibit movement of the portion of the clip with respect to the second mating surface. In a further embodiment of the present invention, at least one of the plug bodies may have a plug indentation therein, and the portion of the clip may be at least partially disposed inside the plug indentation.

The present invention further relates to a method for attaching a clip to a writing instrument. The method may involve (a) positioning at least a portion of a clip between plug bodies, and (b) coupling the plug bodies (with the portion of the clip positioned therebetween) with a retainer element so that the portion of the clip is held between the plug bodies. The retainer element may be coupled to a component of the writing instrument, or the retainer element may be formed as part of the writing instrument.

These and other features and advantages of the present invention will be readily apparent from the following detailed description of the invention, the scope of the invention being set out in the appended claims.

BRIEF DESCRIPTION OF THE DRAWINGS

The detailed description of the present invention will be better understood in conjunction with the accompanying drawings, wherein like reference characters represent like elements, as follows.

DETAILED DESCRIPTION OF THE INVENTION

Figure 1:
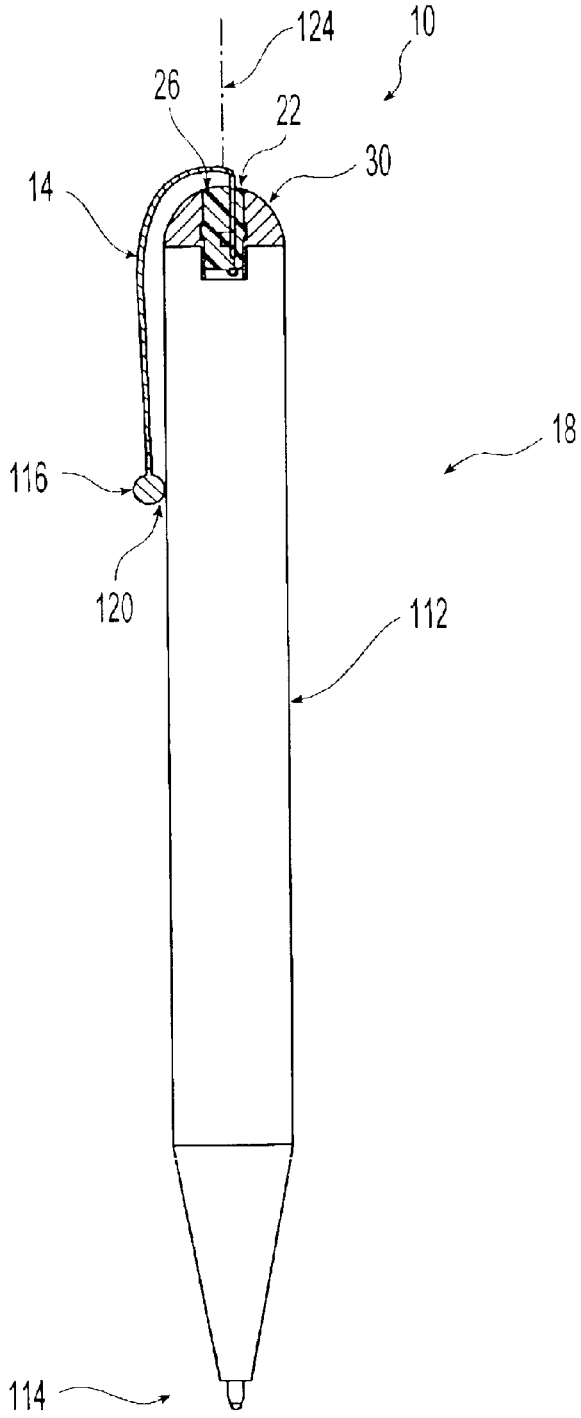
FIG. 1 is an elevational view, partially in cross-section, of a writing instrument formed in accordance with the present invention.

Exemplary clip retention mechanisms embodying the principles of the present invention are shown throughout the drawings and will now be described in detail. In the following descriptions of various embodiments of the present invention, similar elements or components thereof are designated with reference numbers having the same last two digits; redundant description is omitted.

As illustrated in FIGS. 1–6, clip 14, plug bodies 22, 26, and retainer element 30 may be assembled together to form a clip retention apparatus 10 in accordance with the present invention. In one embodiment, the components of clip retention apparatus 10 may be assembled together so that plug bodies 22, 26 enclose, and extend along the length of, a portion of clip 14. As described in greater detail below, plug bodies 22, 26, in cooperation with retainer element 30, may secure clip 14 to a portion of a writing instrument 18. It should be appreciated that the term "writing instrument 18" is intended to reference generically a writing instrument and includes, inter alia, a main body portion, a cap, and/or other parts that may make up a writing instrument. Illustration of a writing instrument 18 in FIG. 1 without a cap is thus exemplary and is not intended to limit the scope of the present invention.

In accordance with the present invention, a portion of clip 14 may be maintained (i.e., held or locked) between a first plug body 22 and a second plug body 26. Plug bodies 22, 26, with clip 14 disposed therebetween, may be held together by a retainer element 30, which may engage plug bodies 22, 26, such as by being arranged around plug bodies 22, 26. Retainer element 30 may be secured to, or formed as a part of, writing instrument 18 and may be disposed at one end of writing instrument 18, typically opposite the writing end 114 of writing instrument 18.

In the following description, one of the plug bodies 22 may be referred to as "first plug body 22," and the other plug body 26 may be referred to as "second plug body 26." Such references are merely for convenience and should not be construed to limit the claims presented below. For example, each of the features provided by first plug body 22 may, alternatively or in addition, be provided by second plug body 26, and vice versa.

Plug bodies 22, 26 and clip 14 may be designed with mating profiles to facilitate assembly and/or alignment of clip 14 with respect to plug bodies 22, 26 and assembly and/or alignment of plug bodies 22, 26 with respect to each other during assembly. Such configuration may be helpful in maintaining the components of clip retention apparatus 10 together as a unit during assembly. For example, at least one of plug bodies 22, 26 may be configured with one or more structural features to facilitate assembly and/or alignment of clip 14 and plug bodies 22, 26. In one embodiment, first plug body 22 may have an inner plug protrusion 42 formed thereon for engaging a mating plug cavity 50 formed on second plug body 26. Protrusion 42 may be configured to interlock with plug cavity 50 so that first plug body 22 and second plug body 26 are held together during assembly of clip retention apparatus 10 (e.g., before plug bodies 22, 26 are coupled with and held together by retainer element 30). For example, plug cavity 50 may be configured to tightly receive protrusion 42, as with a press-fit or snap-fit configuration, so that protrusion 42 is held within plug cavity 50. In some embodiments, inner plug protrusion 42 may have a particular cross-sectional shape, and plug cavity 50 may have a mating cross-sectional shape, such as similar triangular, rectangular, or circular cross-sectional shapes. Alternatively, protrusion 42 and plug cavity 50 may have various other, not necessarily corresponding, cross-sectional shapes.

Figure 2:
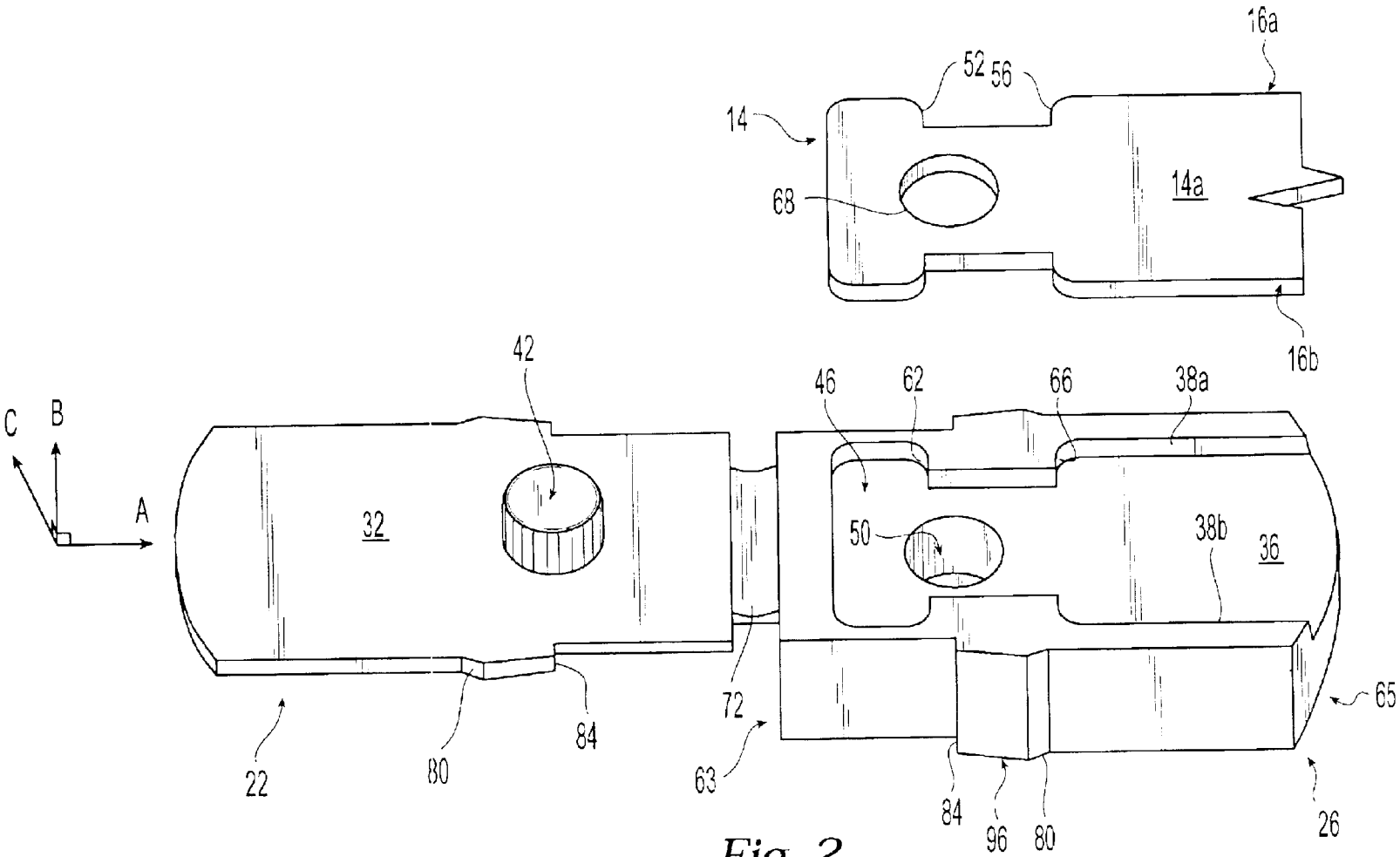
FIG. 2 is an exploded view of first and second plug bodies and a portion of a clip formed in accordance with the present invention.
Figure 3:
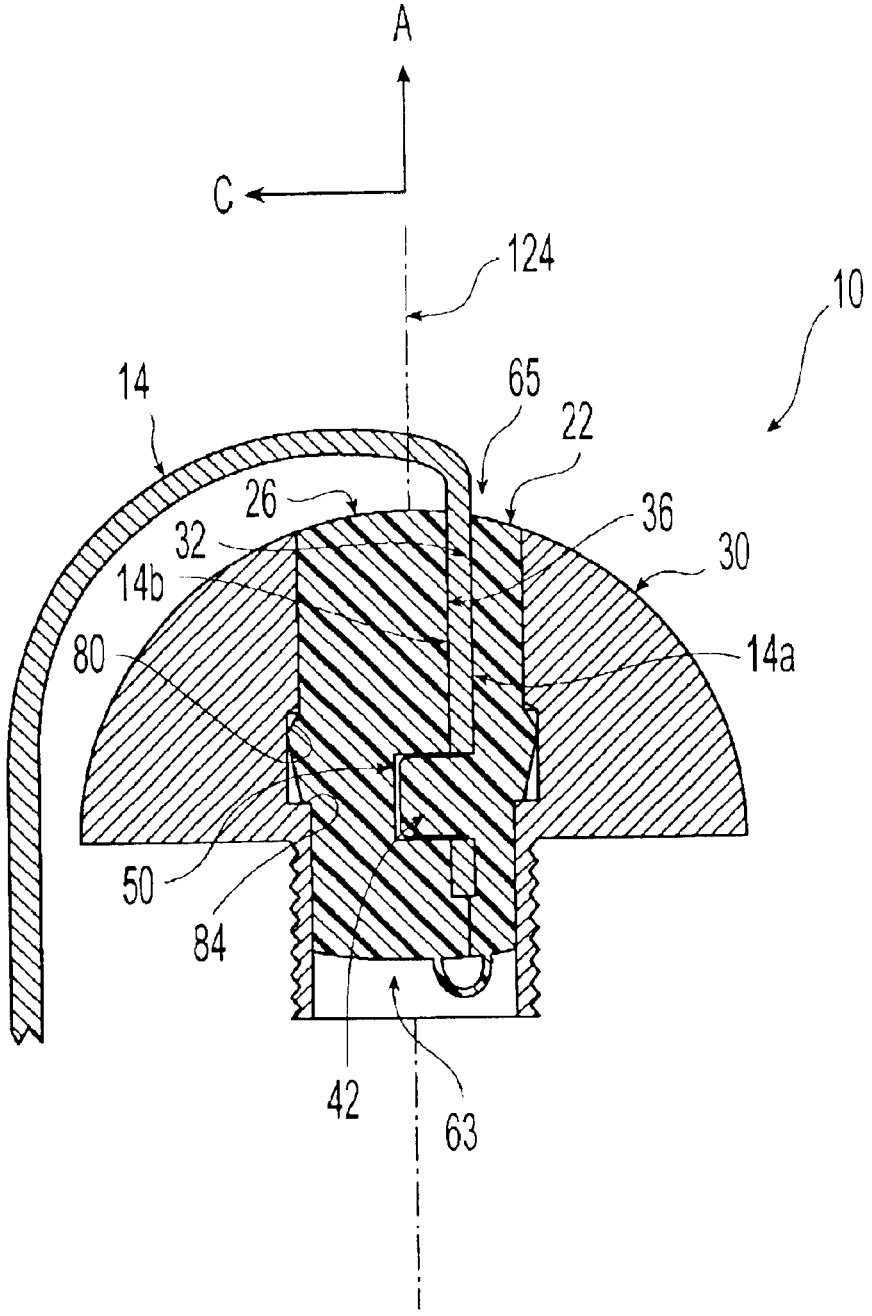
FIG. 3 is a cross-sectional view of the clip retention apparatus of FIG. 1, further illustrating the internal structure of the clip retention apparatus.
Figure 4:
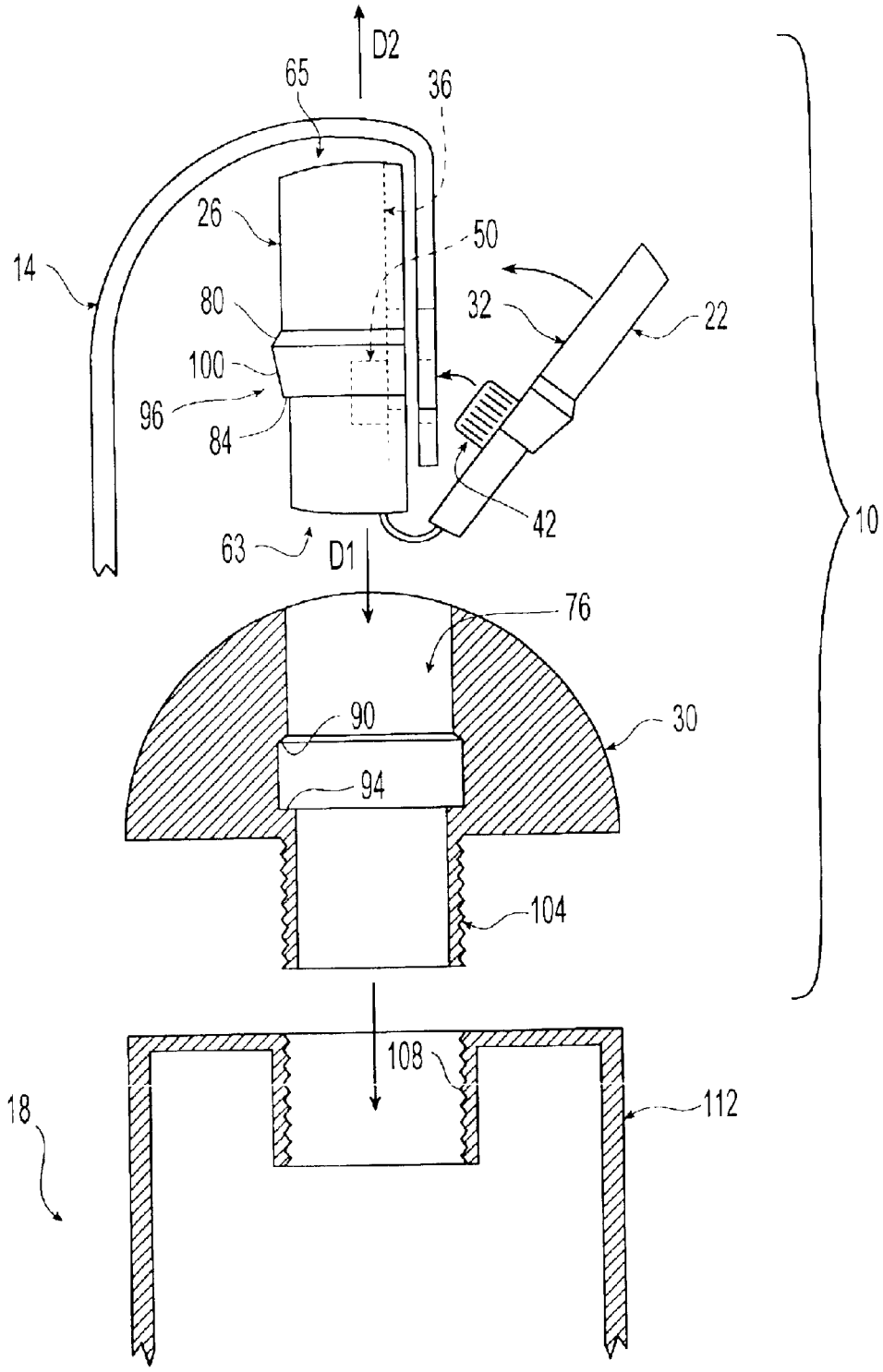
FIG. 4 is an explored view, partially in cross-section, of the clip retention apparatus of FIG. 1.

In the embodiments of FIGS. 2–4, clip 14 has a clip opening 68 through which protrusion 42 may pass. Thus, clip 14 may be arranged between plug bodies 22, 26 so that inner plug protrusion 42 passes through clip opening 68 and is received by plug cavity 50. With such an arrangement, protrusion 42 may facilitate proper alignment of first plug body 22, clip 14, and second plug body 26, and protrusion 42 may hold the plug-and-clip assembly together before the assembly is coupled to retainer element 30 and writing instrument 18. It should appreciated that such configuration also may contribute to maintaining clip 14 with respect to plug bodies 22, 26. It should further be appreciated that clip opening 68 need not be a through-hole and may be configured, instead, as a slot or open-sided notch so that inner plug protrusion 42 is received within, but is not necessarily enclosed by, clip opening 68.

As illustrated in FIGS. 1–6 and as discussed in detail below, plug bodies 22, 26 may be configured and arranged to maintain (e.g., to hold or to lock) a portion of clip 14 therebetween to inhibit or to prevent relative movement of clip 14 with respect to plug bodies 22, 26. For example, first and second plug bodies 22, 26 may have first and second engaging surfaces 32, 36 for engaging clip 14. Preferably, engaging surfaces 32, 36 cooperate to engage clip 14 securely so that clip 14 may not be easily removed from between plug bodies 22, 26 once clip retention apparatus 10 is fully assembled onto writing instrument 18. For example, after clip 14 is assembled between plug bodies 22, 26, engaging surfaces 32, 36 may be drawn tightly together, as by retainer element 30, to tightly engage and securely hold clip 14 therebetween. Thus, movement of clip 14 with respect to plug bodies 22, 26 may be inhibited by engagement between clip 14 and engaging surfaces 32, 36.

In the embodiment illustrated in FIG. 2, at least one of plug bodies 22, 26 is shaped and configured to hold and to at least inhibit movement of clip 14 with respect to plug bodies 22, 26. For example, at least one of engaging surfaces 32, 36 may provide one or more mating surfaces for engaging one or more corresponding mating surfaces on clip 14 and for opposing relative movement of clip 14. As illustrated in FIG. 2, clip 14 may provide a contoured profile, and at least one of engaging surfaces 32, 36 may provide a plug indentation 46 having a mating contoured profile for receiving, engaging, and opposing relative movement of clip 14. As further illustrated in FIG. 2, clip 14 may have a contoured profile that defines a "T" shape, and one (or both) of engaging surfaces 32, 36 may have an indentation 46 therein with a mating "T-shaped" profile for receiving at least the "T-shaped" portion of clip 14. Thus, movement of clip 14 between plug bodies 22, 26 may be inhibited by interlocking engagement between the "T-shaped" profile of clip 14 with the "T-shaped" profile of indentation 46. It should be appreciated that other mating shapes and profiles, in addition or in alternative to a "T-shaped" profile, may be used in accordance with the present invention. It should further be appreciated that the contoured profile of indentation 46 need not be identical to the contoured profile of clip 14. Also, the above-described protrusion 42 and clip opening 68 may at least contribute to the inhibition of movement of clip 14 with respect to plug bodies 22, 26.

Figure 5:
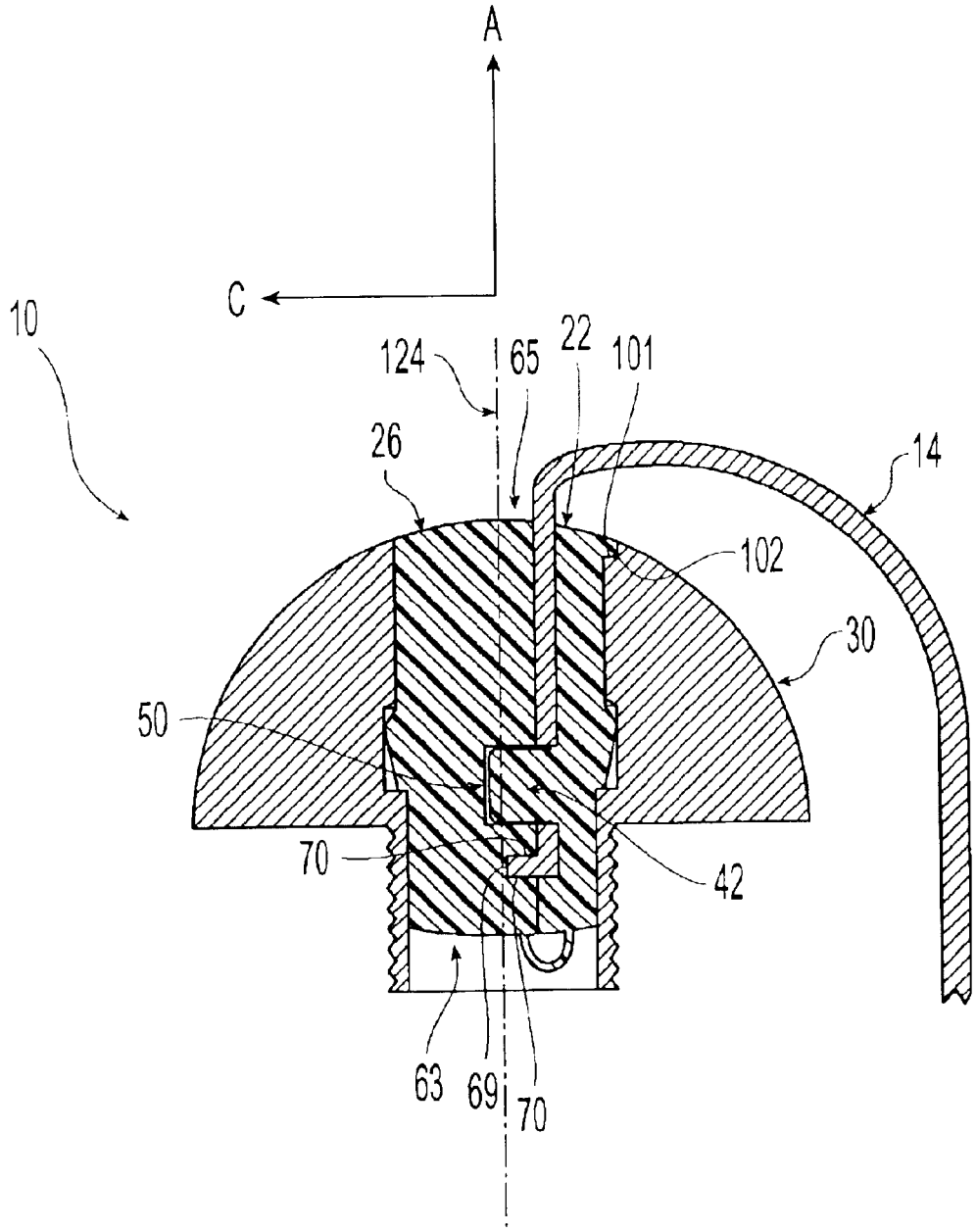
FIG. 5 is a cross-sectional view of another embodiment of a clip retention apparatus formed in accordance with the present invention.

In accordance with the present invention, at least one of plug bodies 22, 26 may be configured to inhibit movement of clip 14 with respect to plug bodies 22, 26 in at least one direction. For example, at least a portion of at least one of plug bodies 22, 26 may be configured to inhibit movement of clip 14 along at least longitudinal axis A of plug bodies 22, 26. It should be appreciated that inhibition or prevention of movement along at least one direction, as described with respect to various embodiments below, may also inhibit or prevent movement along another axis as well. As illustrated in FIG. 2, second plug body 26 may define first and second interior plug shoulders 62, 66 for engaging first and second clip shoulders 52, 56, respectively. Thus, engagement between first interior plug shoulder 62 and first clip shoulder 52 will inhibit movement of clip 14 along axis A in a first direction (i.e., from a first plug end 63 of plug bodies 22, 26 to a second plug end 65 of plug bodies 22, 26), and engagement between second interior plug shoulder 66 and second clip shoulder 56 will inhibit movement of clip 14 along axis A in a second direction (i.e., from second plug end 65 to first plug end 63). The position of clip 14 with respect to plug bodies 22, 26 may therefore be fixed, or at least inhibited, along longitudinal axis A. It should be appreciated, however, that one or more interior plug shoulders 62, 66 may be configured, instead, to allow minimal or limited axial movement of clip 14 with respect to plug bodies 22, 26 along axis A. It should further be appreciated that alternative embodiments may provide interior plug shoulders having other shapes and configurations, such as one or more posts, walls, or like structure to inhibit movement of clip 14 with respect to plug bodies 22, 26 along axis A. For example, as illustrated in FIG. 5, if clip 14 is formed with a hook or tab 69 thereon, at least one of plug bodies 22, 26 may provide one or more shoulders 70 for engaging tab 69 to at least inhibit axial movement of clip 14 in at least one direction along longitudinal axis A.

Additionally or alternatively, at least one of plug bodies 22, 26 may be configured to inhibit lateral movement of clip 14 in at least one direction transverse to longitudinal axis A. In one embodiment, as illustrated in FIG. 2, the portion of clip 14 held between plug bodies 22, 26 may comprise a generally flat planar piece of material having a length running generally parallel to longitudinal axis A of plug bodies 22, 26 and having a width generally transverse and perpendicular to longitudinal axis A. In such an embodiment, movement of clip 14 along a transverse axis B of plug bodies 22, 26 and parallel to the width of clip 14 may be inhibited by the configuration of at least one of plug bodies 22, 26. As illustrated in FIG. 2, at least one of plug bodies 22, 26 may provide one or more lateral plug shoulders or walls 38*a*, 38*b* for engaging clip side portions 16*a*, 16*b*, respectively. Thus, engagement between lateral plug wall 38*a* and clip side portion 16*a* may inhibit lateral movement of clip 14 along axis B in a first direction (i.e., in the direction of plug wall 38*a*), and engagement between lateral plug wall 38*b* and clip side portion 16*b* may inhibit lateral movement of clip 14 in a second direction (i.e., in the direction of plug wall 38*b*). It should be appreciated that lateral movement of clip 14 may be inhibited by various other shapes or configurations of at least a portion of at least one of plug bodies 22, 26, such as one or more posts.

Additionally or alternatively, at least one of plug bodies 22, 26 may be configured to inhibit rotational movement of clip 14 relative to plug bodies 22, 26 about one or more axes. For example, one or both of engaging surfaces 32, 36 may cooperatively engage clip 14 to inhibit rotation of clip 14 relative to plug bodies 22, 26. In the embodiment of FIG. 3, first engaging surface 32 and second engaging surface 36 engage first clip surface 14*a* and second clip surface 14*b*, respectively, to inhibit rotation of clip 14 relative to plug bodies 22, 26 about longitudinal axis A of plug bodies 22, 26. Further, engagement between engaging surfaces 32, 36 and clip surfaces 14*a*, 14*b*, respectively, may inhibit rotation of clip 14 relative to plug bodies 22, 26 about an axis transverse to axis A of plug bodies 22, 26, such as along axis B. In addition or in the alternative, lateral plug shoulders or walls 38*a*, 38*b* may inhibit rotation of clip 14 relative to plug bodies 22, 26 about a transverse axis C, which is normal to the planes generally defined by engaging surfaces 32, 36 as illustrated in FIG. 2.

It should be appreciated that the above-described manners of inhibiting movement of clip 14 with respect to plug bodies 22, 26 also may result in reduction, if not elimination, of relative movement between clip 14 and writing instrument 18 once clip retention apparatus 10 is fully assembled with writing instrument 18.

Plug bodies 22, 26 may be formed of various types and kinds of materials. Preferably, plug bodies 22, 26 are formed from material that is sufficiently rigid to secure clip 14 firmly to writing instrument 18 during use of clip 14 yet also is somewhat flexible or deformable to facilitate assembly of clip retention apparatus 10, as described below. In one embodiment, at least one of plug bodies 22, 26 is molded from a resilient material that retains its resilient character over a long period of time and resists holding a set when deformed, such as an acetal resin material. For example, at least one of plug bodies 22, 26 may be formed from DELRIN ®, an acetal resin material having a resilient character and sold by E. I. du Pont De Nemours And Company of Wilmington, Del. It should be appreciated that many other types of materials, such as nylon, ABS, polypropylene, brass, or steel, may be used to form plug bodies 22, 26. Further, plug bodies 22, 26 may provide various visual effects, such as being colored, transparent, translucent, or opaque.

In one embodiment, plug bodies 22, 26 may be connected together by a hinge 72 and may be folded together to capture clip 14 therebetween. For example, as indicated in FIG. 2, plug bodies 22, 26 may be molded as a single piece of material with plug bodies 22, 26 being connected together by a flexible hinge portion 72. As may be appreciated, the material selected for forming a unitary embodiment should be flexible to permit appropriate flexing of hinge portion 72. Such a construction of plug bodies 22, 26 reduces the number of components in clip retention apparatus 10 and may simplify assembly of clip retention apparatus 10. In alternative embodiments, plug bodies 22, 26 may be formed, instead, as separate pieces.

In accordance with the present invention, plug bodies 22, 26, with clip 14 disposed therebetween, may be secured to writing instrument 18 via a retainer element 30, which may be secured to, or formed as a part of, writing instrument 18. Retainer element 30 and plug bodies 22, 26 may be shaped and configured to interlock or otherwise be maintained together. For example, as illustrated in FIG. 4, retainer element 30 may have a retainer opening 76 formed therein for receiving and holding plug bodies 22, 26 therein. If desired, retainer opening 76 may be shaped to interlock or mate with at least one of plug bodies 22, 26 so that plug bodies 22, 26 are maintained (i.e., held or locked) within retainer opening 76. For example, retainer opening 76 may be configured to tightly receive plug bodies 22, 26, as with a press-fit or snap-fit configuration, so that retainer opening 76 maintains plug bodies 22, 26 within retainer opening 76.

Additionally or alternatively, as illustrated in FIG. 4, at least one of plug bodies 22, 26 may have one or more outer plug shoulders 80, 84 formed thereon for engaging one or more inner retainer shoulders 90, 94, respectively, formed on retainer element 30. Thus, engagement between first outer plug shoulder 80 and first inner retainer shoulder 90 may inhibit axial movement of plug bodies 22, 26 in a first direction, and engagement between second outer plug shoulder 84 and second inner retainer shoulder 94 may inhibit axial movement of plug bodies 22, 26 in a second direction. As a result, plug bodies 22, 26 may be fixed axially with respect to retainer element 30 along longitudinal axis A of plug bodies 22, 26. It should be appreciated, however, that such embodiments may be configured, instead, to allow minimal or limited axial movement of plug bodies 22, 26 with respect to retainer element 30.

As illustrated in FIG. 4, outer plug shoulders 80, 84 may be formed by a plug barb or ridge 96 on at least one of plug bodies 22, 26. Further, at least one of plug bodies 22, 26 may be configured to facilitate insertion of plug bodies 22, 26 into retainer opening 76 and to inhibit removal of plug bodies 22, 26 from retainer opening 76. As illustrated in FIGS. 3 and 4, plug bodies 22, 26, when assembled together with clip 14, may have a smaller cross-section at first plug end 63 than at second plug end 65. Moreover, plug bodies 22, 26 may have a smaller cross-section at second plug shoulder 84 than at first plug shoulder 80. In one embodiment, at least one of plug bodies 22, 26 may have a ramped portion 100 with a sloped profile between second plug shoulder 84 and first plug shoulder 80 that facilitates insertion of first outer plug shoulder 80 into retainer opening 76 and beyond first inner retainer shoulder 90. For example, if plug bodies 22, 26 are formed of a resilient, deformable material, first outer plug shoulder 80 may deform as ramped portion 100 is moved in the first direction D1 (illustrated in FIG. 4) with respect to retainer element 30 and is pressed into the relatively narrow retainer opening 76. When first outer plug shoulder 80 is inserted into retainer opening 76 beyond first retainer shoulder 90, first outer plug shoulder 80 may expand and return to its original shape. Thus, first outer plug shoulder 80 may engage first inner retainer shoulder 90 to at least inhibit removal of plug bodies 22, 26 from retainer opening 76 by inhibiting axial movement of plug bodies 22, 26 in a second direction D2 (illustrated in FIG. 4) with respect to retainer element 30. It should be appreciated that retainer element 30, instead of or in addition to at least one of plug bodies 22, 26, may be formed of a resilient, deformable material and may provide a ramped portion with a sloped profile that facilitates insertion of plug bodies 22, 26 into retainer opening 76. It should further be appreciated, however, that plug bodies 22, 26 may be secured to retainer element 30 in other ways, such as via adhesive, screw(s), rivet(s), or other attachment mechanisms known in the art.

In accordance with the present invention, plug bodies 22, 26 may interlock with retainer element 30 so that plug bodies 22, 26 are inhibited from rotating relative to retainer element 30 about longitudinal axis A of plug bodies 22, 26. In one embodiment, plug bodies 22, 26 and retainer opening 76 may have mating, non-circular cross-sectional shapes, such as mating rectangular, triangular, or other non-circular cross-sectional shapes, so that rotation of plug bodies 22, 26 relative to retainer element 30 about longitudinal axis A is inhibited by engagement of the mating cross-sectional shapes. Alternatively, plug bodies 22, 26 and retainer opening 76 may be provided with circular cross-sectional shapes and plug bodies 22, 26 may be press-fit into retainer opening 76 so that rotation of plug bodies 22, 26 is inhibited by the press-fit configuration. Additionally or alternatively, only a portion of at least one of plug bodies 22, 26 may interlock with a portion of retainer element 30. For example, as illustrated in FIG. 5, at least one of plug bodies 22, 26 may have an outer tab or notch 101 about its outer circumference that engages a mating inner notch or tab 102 disposed on retainer element 30 for preventing rotation of plug bodies 22, 26 relative to retainer element 30.

Retainer element 30 may be secured to writing instrument 18 via mating threads on retainer element 30 and writing instrument 18. For example, as illustrated in FIG. 4, retainer element 30 may have a threaded retainer shaft 104 thereon for engaging mating threads 108 on at least one component of writing instrument 18, such as on a barrel or body member 112 (e.g. , as in FIG. 1) or a cap 113 of writing instrument 18. Alternatively, threaded retainer shaft 104 may be inserted through a hole in one end of body member 112 or cap 113 to engage a threaded nut inside body member 112 or cap 113.

Figure 6:
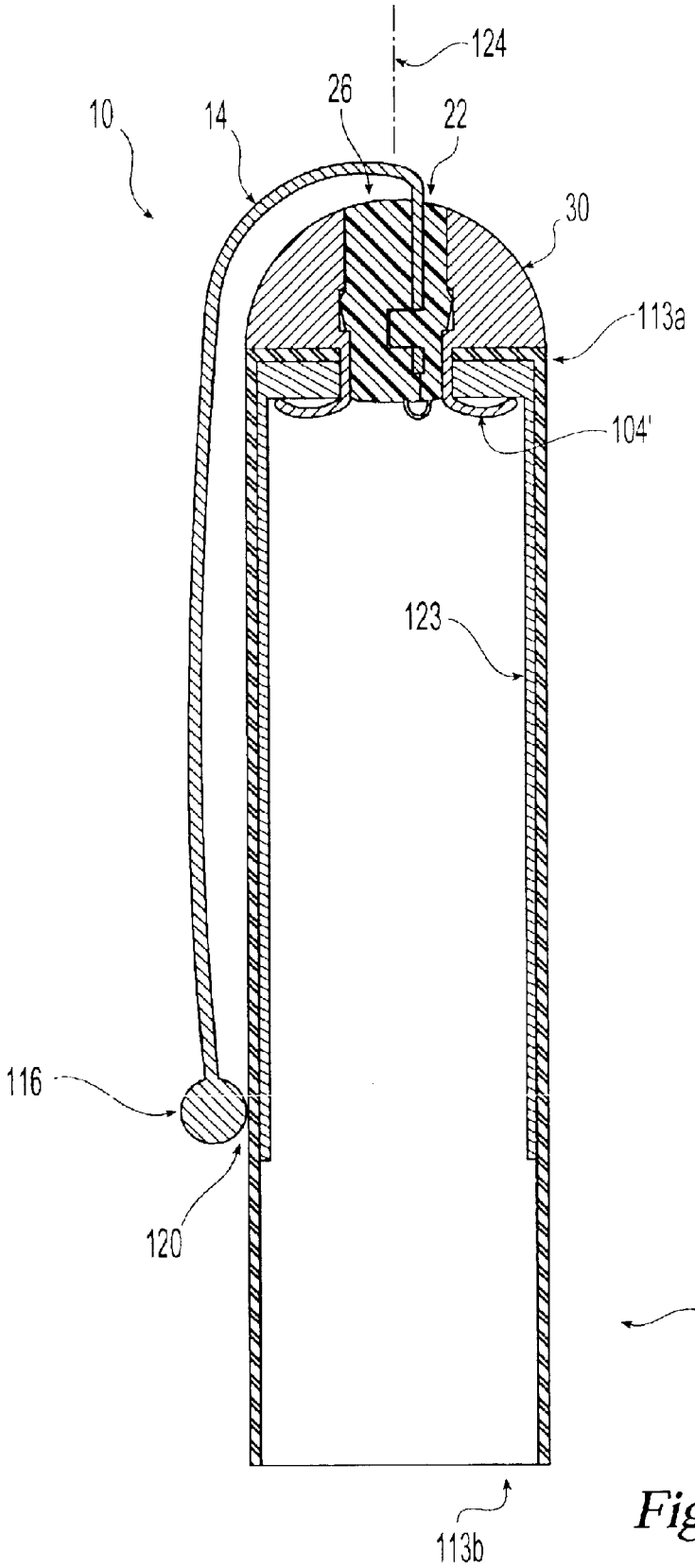
FIG. 6 is a cross-sectional view of another embodiment of a clip retention apparatus formed in accordance with the present invention and attached to the cap of a writing instrument.

In other embodiments, retainer element 30 may be secured to a writing instrument via one or more rivets. For instance, as illustrated in FIG. 6, retainer element 30 may provide a retainer shaft 104' that is inserted into a hole in writing instrument 18 (in this example in the closed end 113*a* of cap 113) and then is riveted or deformed (e.g., by an arbor) to secure the retainer element 30 thereto. When coupled to a cap 113, retainer element 30 may also secure a liner 123, or vapor seal, to the inside of cap 113. For example, before retainer shaft 104' is riveted to cap 113, a liner 123 maybe inserted into the open end 113*b* of cap 113 so that retainer shaft 104' also passes through a hole in liner 123. When the retainer shaft 104' is subsequently riveted or deformed, the retainer shaft 104' will therefore secure both the retainer element 30 and the liner 123 to cap 113. Cap 113 with retainer element 30 and liner 123 attached thereto, may be positioned on the writing end of body member 112 so that liner 123 prevents evaporation of the ink in writing instrument 18. It should be appreciated that retainer element 30 may, alternatively, be secured to writing instrument 18 via one or more screws or other attachment mechanisms known in the art.

Retainer element 30 may be formed from various types and kinds of materials, such as brass, aluminum, stainless steel, or molded plastic. Moreover, retainer element 30 may be plated with various materials, such as nickel, gold, or chrome.

In alternative embodiments, retainer element 30 may be integrally formed with one of the components of writing instrument 18, such as cap 113 or body member 112. For example, an end of writing instrument 18, such as the closed end 113*a* of cap 113 or the non-writing end of body member 112, may be configured, such as with a retainer opening 76 formed therein, for engaging plug bodies 22, 26. Alternatively, retainer element 30 may be formed, instead, on the side of cap 113 or body member 112 of writing instrument 18 rather than on an axial end thereof.

In the embodiments shown in FIGS. 1 and 6, retainer element 30 is disposed, respectively, at the non-writing end of body member 112 or at the closed end 113*a* of cap 113. In such embodiments, the portion of clip 14 not held between plug bodies 22, 26 may be appropriately bent with respect to the portion of clip 14 held between plug bodies 22, 26 to extend along the length of body member 112 or cap 113 toward the opposite end of body member 112 or cap 113.

In accordance with the present invention, clip 14 may be pre-bent before clip 14 is inserted between plug bodies 22, 26 and secured to writing instrument 18. Thus, if a manufacturer desires to provide a plated clip 14, the clip 14 may be plated after the bending process so that the plating is not flaked or cracked by the bending process.

It should be appreciated that the spacing of clip end 116 from writing instrument 18 (e.g., body member 112 or cap 113) affects the clip tension. Thus, the clip tension at a contact point 120 on writing instrument 18 (or on an element disposed between clip 14 and writing instrument 18) may be modified by altering the pre-bend angle of clip 14 or by altering the position of clip 14 with respect to writing instrument 18. For example, the position of clip 14 may be altered with respect to plug bodies 22, 26 and centerline 124 of writing instrument 18. As illustrated in FIG. 3, clip retention apparatus 10 may be designed so that the portion of clip 14 disposed between plug bodies 22, 26 is offset from centerline 124. For example, first plug body 22 may have a thinner cross-section than second plug body 26 so that the portion of clip 14 disposed between plug bodies 22, 26 is offset from centerline 124. It should be appreciated that altering the relative dimensions of plug bodies 22, 26 may alter the position of clip 14 with respect to centerline 124 and may, therefore, alter the clip tension at contact point 120.

In accordance with the present invention and as shown in FIG. 5, if a pre-bent clip 14 is turned 180° from the orientation shown in FIG. 3 and if longitudinal axis A is substantially coaxial with centerline 124, the clip tension between clip 14 and writing instrument 18 may be decreased. Thus, the same pre-bent clip 14 may be assembled differently with respect to plug bodies 22, 26 to achieve different clip tensions. For example, clip 14, when oriented as illustrated in FIG. 3, will have a greater clip tension with respect to a writing instrument 18 to which clip 14 is coupled than when oriented to face the opposite direction (as illustrated in FIG. 5).

Moreover, the same clip retention apparatus 10 may be used with writing instruments having different diameters. For example, when such an apparatus 10 is used with a small diameter writing instrument, clip 14 may be oriented as in FIG. 3. Alternatively, when the same apparatus 10 is used with a large diameter writing instrument, clip 14 may be oriented as in FIG. 5 wherein clip 14 is turned 180° from the orientation shown in FIG. 3. It should be appreciated, however, that clip 14 and plug bodies 22, 26 may be configured, instead, so that clip 14 may only be assembled with respect to plug bodies 22, 26 in a single orientation.

Clip 14 may be formed of various types of materials, such as carbon steel, stainless steel, or plastic. Moreover, as indicated above, clip 14 may be plated with various materials, such as nickel, gold, chrome, or palladium. In addition, clip 14 may have various shapes and sizes. For example, clip 14 may have a predetermined cross-sectional shape, such as a triangular. rectangular or circular cross sectional shape.

It should be appreciated that the various features and components described herein may be used singly or in any combination thereof. For example, plug bodies 22, 26 may be formed without outer plug shoulders 80, 84 or interior plug shoulders 62, 64 thereon. Alternatively, plug bodies 22, 26 may be formed with only one of outer plug shoulders 80, 84 and interior plug shoulders 62, 64. Similarly, other elements and features of the clip retention apparatus 10 described herein may be used in various combinations, alterations, and embodiments.

Thus, the present invention is not limited to only the embodiments specifically described herein. It should be appreciated that other applications of the disclosed clip retention apparatus 10 in addition to those described herein are also within the scope of the present invention. For example, the disclosed clip retention apparatus 10 may be used with many types and kinds of devices in addition to writing instruments.

While the foregoing description and drawings may represent preferred embodiments of the present invention, it should be understood that various additions, modifications, and substitutions may be made therein without departing from the spirit and scope of the present invention as defined in the accompanying claims. In particular, it will be clear to those skilled in the art that the present invention may be embodied in other specific forms, structures, arrangements, and proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A clip retention apparatus adapted to be used with a writing instrument, said apparatus comprising:

a clip;

a first plug body having a first engaging surface; and a second plug body having a second engaging surface;

wherein:

at least a portion of said clip is disposed between said first engaging surface and said second engaging surface;

said first engaging surface and said second engaging surface engage said portion of said clip to at least inhibit movement of said portion of said clip with respect to said plug bodies;

said clip, said first plug body, and said second plug body are configured for insertion, as a unit, into a retainer element adapted to be coupled to a writing instrument, whereby said clip is coupled to the writing instrument by insertion of said first plug body and said second plug body, together, into said retainer element.

2. The clip retention apparatus of claim 1, wherein:

said portion of said clip defines a first mating surface;

at least one of said first engaging surface and said second engaging surface defines a second mating surface; and said first mating surface engages said second mating surface to at least inhibit movement of said portion of said clip with respect to said second mating surface.

3. The clip retention apparatus of claim 1, wherein said plug bodies are connected together by a flexible hinge element.

4. The clip retention apparatus of claim 1, wherein:

one of said plug bodies has an inner plug protrusion wherein;

the other of said plug bodies has a mating plug cavity therein; and said inner plug protrusion is received within said mating plug cavity to maintain said plug bodies together.

5. The clip retention apparatus of claim 4, wherein said inner plug protrusion interlocks with said mating plug cavity.

6. The clip retention apparatus of claim 1, wherein:

one of said plug bodies has an inner plug protrusion thereon;

said clip has an opening therein for receiving said inner plug protrusion; and said inner plug protrusion is received within said opening in said clip.

7. The clip retention apparatus of claim 1, wherein:

at least one of said plug bodies has a plug indentation therein; and said portion of said clip is at least partially disposed inside said plug indentation.

8. The clip retention apparatus of claim 7, wherein:

said portion of said clip has a contoured clip profile;

said plug indentation has a mating contoured profile; and said mating contoured profile engages said contoured clip profile to at least inhibit movement of said portion of said clip with respect to said plug bodies.

9. The clip retention apparatus of claim 7, wherein:

said plug indentation defines a plug shoulder;

said portion of said clip defines a clip shoulder; and said plug shoulder engages said clip shoulder to at least inhibit movement of said clip with respect to said plug bodies.

10. The clip retention apparatus of claim 1, wherein:

at least one of said plug bodies defines a plug shoulder;

said portion of said clip defines a clip shoulder; and said plug shoulder engages said clip shoulder to at least inhibit movement of said clip from between said plug bodies.

11. The clip retention apparatus of claim 1, wherein:

at least one of said plug bodies defines one or more plug shoulders; and said one or more plug shoulders engage said clip to at least inhibit lateral movement of said clip between said plug bodies.

12. The clip retention apparatus of claim 1, wherein:

at least one of said first engaging surface and said second engaging surface is configured and arranged with respect to said portion of said clip to at least inhibit rotation of said portion of said clip relative to said plug bodies about the longitudinal axis of said plug bodies.

13. A writing instrument comprising:

a body member having a first end and a second end;

a clip;

a first plug body having a first engaging surface;

a second ping body having a second engaging surface; and a retainer element associated with said body member;

wherein;

at least a portion of said clip is disposed between said first engaging surface and said second engaging surface;

said first engaging surface and said second engaging surface engage said portion of said clip to at least inhibit movement of said portion of said clip with respect to said plug bodies; and said plug bodies are shaped to interlock with said retainer element to inhibit movement with respect to retainer element.

14. The clip retention apparatus of claim 13, wherein:

at least one of said plug bodies has an outer plug shoulder;

said retainer element has an inner retainer shoulder; and said inner retainer shoulder engages said outer plug shoulder to maintain said plug bodies inside said retainer element.

15. The clip retention apparatus of claim 14, wherein said outer plug shoulder is defined by a ridge formed about the outside surface of said at least one of said plug bodies.

16. The clip retention apparatus of claim 15, wherein said ridge defines a ramped portion having a sloped profile for facilitating insertion of said plug bodies into said retainer element.

17. The clip retention apparatus of claim 14, wherein at least one of said first plug body, said second plug body, and said retainer element defines a ramped portion having a sloped profile for facilitating insertion of said plug bodies into said retainer element.

18. The clip retention apparatus of claim 14, wherein said outer plug shoulder is formed of a resilient material.

19. The writing instrument of claim 13, wherein said retainer element is formed as a part of said body member.

20. The writing instrument of claim 13, further comprising a cap member positioned at said first end of said body member, wherein said retainer element is disposed on said cap member.

21. The writing instrument of claim 13, wherein:

said retainer element is configured for coupling with at least one component of said writing instrument.

22. The writing instrument of claim 13, wherein said plug bodies and said retainer element are shaped to inhibit relative axial movement.

23. The writing instrument of claim 13, wherein said plug bodies and said retainer element are shaped to inhibit relative rotational movement.

24. A clip retention apparatus comprising:

a clip having a first mating surface;

a first plug body having a first engaging surface;

a second plug body having a second engaging surface; and a retainer clement;

wherein:

said retainer clement is coupled to said plug bodies to maintain said plug bodies together;

at least a portion of said clip is disposed between said first engaging surface and said second engaging surface;

at least one of said first engaging surface and said second engaging surface defines a second mating surface; and said first mating surface engages said second mating surface to at least inhibit movement of said portion of said clip with respect to said plug bodies.

25. A method for attaching a clip to a writing instrument comprising a plurality of components, including a retainer element, a first plug body and a second plug body, said method comprising:

positioning at least a portion of said clip between said first plug body and said second plug body; and coupling said first and second plug bodies, with said portion of said clip positioned therebetween, with said retainer element so that said portion of said clip is held between said first plug body and said second plug body.

26. The method of claim 25, further comprising:

coupling said retainer element to at least one component of said writing instrument.

27. The method of claim 26, wherein said retainer element is coupled to a body member of said writing instrument.

28. The method of claim 26, wherein said retainer element is coupled to a cap of said writing instrument.

29. The method of claim 25, further comprising coupling said first and second plug bodies together so that said plug bodies engage each other to at least inhibit relative movement therebetween.

30. The method of claim 29, further comprising coupling a plug protrusion on one of said plug bodies with a mating plug cavity of the other of said plug bodies.

31. A clip retention apparatus for a writing instrument, said apparatus comprising:

a clip;

a first plug body having a first engaging surface; and a second plug body having a second engaging surface;

wherein:

at least a portion of said clip is disposed between said first engaging surface and said second engaging surface; and said plug bodies are each molded front a resilient material and are connected together by a flexible hinge.

32. The clip retention apparatus claim 31, wherein said plug bodies are configured with mating profiles that engage each other to hold said plug bodies together.

33. The clip retention apparatus of claim 32, wherein said mating profiles are further configured to engage said portion of said clip to inhibit movement of said portion of said clip with respect to said plug bodies.

34. A clip retention apparatus configured for coupling a clip to a writing instrument with a centerline, said apparatus comprising:

a clip;

a first plug body having a first engaging surface; and a second plug body having a second engaging surface;

wherein:

said first and second plug bodies define a mutual central longitudinal axis; and at least a portion of said clip is disposed between said first engaging surface and said second engaging surface parallel and offset from said mutual central longitudinal axis of said first and second plug bodies.

35. The clip retention apparatus of claim 34, wherein:

said clip is prebent to shape said clip into a first portion to be disposed between said first and second engaging surfaces and a second portion to extend outside a writing instrument for clipping the writing instrument onto an object;

in a first position of said first portion of said clip between said first engaging surface and said second engaging surface, said second portion of said clip is a first distance from said first and second plug bodies; and in a second position of said first portion of said clip between said first engaging surface and said second engaging surface, said second portion of said clip is a second distance from said first and second plug bodies, said second distance being greater than said first distance.

36. A clip retention apparatus configured for coupling a clip to a writing instrument with a centerline, said apparatus comprising:

a clip;

a first plug body having a first engaging surface; and a second plug body having a second engaging surface;

wherein:

said first and second plug bodies define a mutual central longitudinal axis;

said first and second plug bodies are configured to be held together with a portion of said clip arranged between said first engaging surface and said second engaging surface; and when said first and second plug bodies are held together, said first engaging surface and said second engaging surface are offset from said mutual central longitudinal axis of said first and second plug bodies.

37. The clip retention apparatus of claim 36, wherein:

said clip is prebent to shape said clip into a first portion to be disposed between said first and second engaging surfaces and a second portion extend outside a writing instrument for clipping the writing instrument onto an object;

in a first position of said first portion of said clip between said first engaging surface and said second engaging surface, and said second portion of said clip is a first distance from said first and second plug bodies; and in a second position of said first portion of said clip between said first engaging surface and said second engaging surface, said second portion of said clip is a second distance from said first and second plug bodies, said second distance being greater than said first distance.

38. The clip retention apparatus of claim 36, wherein said first plug body has a thinner cross-section than said second plug body.

39. A method of assembling a clip on a writing instrument having a centerline, said method comprising:

positioning at least a portion of a clip between a first engaging surface of a first plug body and a second engaging surface of a second plug body, the first and second plug bodies defining a mutual central longitudinal axis; and coupling the first and second plug bodies, with the portion of the clip positioned therebetween, to the writing instrument with the mutual central longitudinal axis of the first and second plug bodies substantially parallel to the centerline of the writing instrument;

wherein:

the first engaging surface and the second engaging surface are substantially parallel to and offset from the writing instrument centerline; and the tension of the clip with respect to the writing instrument is adjustable by altering the position of the clip portion positioned between the first and second ping bodies.

40. The method of claim 39, further comprising adjusting the tension of the clip by rotating by 180° the position of clip portion between the first and second plug bodies.

* * * * *